US007520344B1

(12) United States Patent
Keck

(10) Patent No.: US 7,520,344 B1
(45) Date of Patent: Apr. 21, 2009

(54) WEAR RESISTANT COLLAR FOR SUB ASSEMBLY

(76) Inventor: Clark Barton Keck, 2339 1/2 A Rattle Snake Ct., Grand Junction, CO (US) 81503

( * ) Notice: Subject to any disclaimer, the term of this patent is extended or adjusted under 35 U.S.C. 154(b) by 0 days.

(21) Appl. No.: 12/051,742

(22) Filed: Mar. 19, 2008

(51) Int. Cl.
*E21B 17/10* (2006.01)

(52) U.S. Cl. ..... 175/325.5; 166/241.6

(58) Field of Classification Search ..... 175/325.4, 175/325.5, 325.7; 166/241.6, 241.7
See application file for complete search history.

(56) References Cited

U.S. PATENT DOCUMENTS 3,697,141 A * 10/1972 Garrett ..... 175/325.5
4,296,973 A * 10/1981 Hartwell ..... 175/325.4

* cited by examiner

*Primary Examiner*—William P Neuder
(74) *Attorney, Agent, or Firm*—Buskop Law Group, PC; Wendy Buskop

(57) ABSTRACT

A collar for protecting a body inside a borehole of a well, with a collar outer diameter larger than the body outer diameter, a plurality of offset indentations formed on the outer side of the collar formed in rows of four to eight offset indentations along a diagonal orientation to a collar axis. A metal carbide inserts engages each offset indentation with an interference fit forming a wear resistant pad on the outer side of the collar. A sealing means is disposed between a bottom beveled edge of a collar and the body forming a sealed sub assembly. At least two spring locking apparatus engaging a locking portion on the body.

9 Claims, 4 Drawing Sheets

WEAR RESISTANT COLLAR FOR SUB ASSEMBLY

FIELD

The present embodiments relate to a removable, interchangeable, replaceable, wear resistant collar for drill pipe, and bottom hole assemblies that has a wear pad formed using metal carbide inserts disposed on the collar.

BACKGROUND

A need exists for an inexpensive, easy to use collar, that prevents casing wear, including drilling tubulars.

A further need exists for an easily replaceable collar that is easy to use in the field, ease to remove and install, and does not fail easily during use.

The present embodiments meet these needs.

BRIEF DESCRIPTION OF THE DRAWINGS

The detailed description will be better understood in conjunction with the accompanying drawings as follows.

Figure 1:
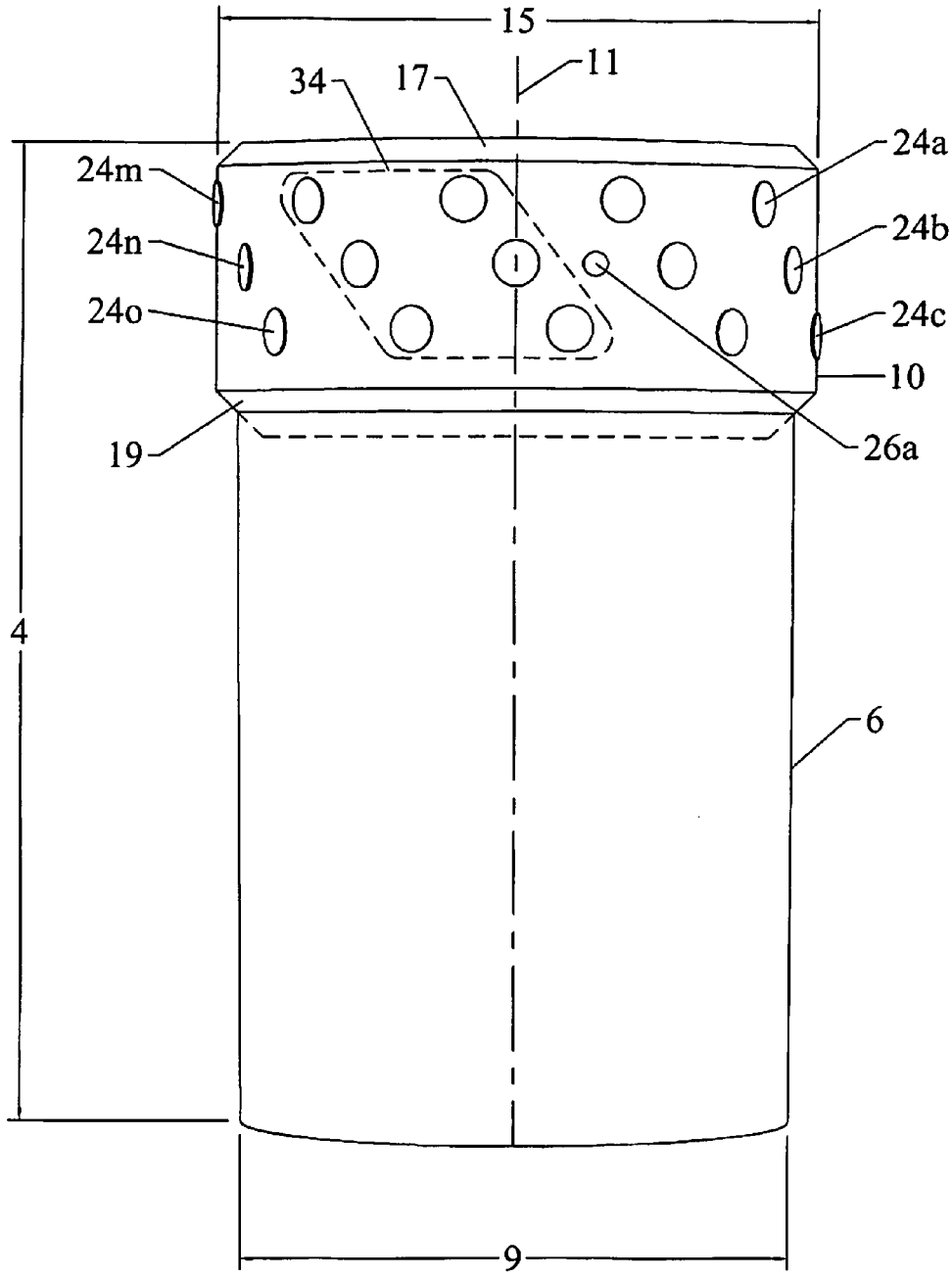
FIG. 1 depicts a side view of an embodiment of the collar engaging a body of a sub.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The invention relates to a wear resistant collar that is uniquely reparable in the field and easy to replace in the field. The collar is for use on a sub body inside a borehole of a well such as a natural gas well. The collar can be used in other wells, such as wells created and used for mining natural resources, an oil well or even a water well.

The collar, which is also referred to herein as a "casing saver" can range in length from about 2 inches to about 10 inches. In an embodiment, it can be 2.66 inches in length, have a wall thickness between about 0.4 inches and about 1.5 inches, and an inner diameter between about 4.5 inches and about 10 inches, such as an inner diameter between about 6 inches and about 7 inches.

The collar can be longer than the above ranges, if use merits, or even slightly shorter in length if required to cover a short piece of pipe.

The collar can have a larger wall thickness than those noted above, up to 2 inches in thickness for very heavy drilling operations.

The collar has an inner side which slips over a body of a sub, or over a tubular so that the two form a wear protected sub assembly.

The collar can slip over milled drilling tubulars, and form a protected tubular.

The collar has an outer side slightly larger than outer diameter of the body of the sub. The collar can be about ¼ inch larger in diameter to about 2 inches larger in diameter than the tubular or body of the sub.

The collar separates the tubular or sub body from the walls of the well bore or from drilling muds or other fluids with or without particulate that flow in the well.

The collar is formed with a plurality of offset indentations that are oriented on a diagonal pattern, tangent to the axis of the collar. More specifically, the offset indentations are oriented at an angle between about 7.5 degrees and about 45 degrees from the collar axis.

The offset indentations can be arranged in a linear fashion or a curvilinear fashion.

Each offset indentation in an embodiment is contemplated to be generally circular in shape. Other shapes may be considered as usable herein. The shape will somewhat depend on the shape of the body of the metal insert to be connected to the offset indentation. If the body of the insert is square, the offset indentations should be generally angular. If the body of the insert is cylindrical, the offset indentations should be somewhat rounded.

Each of the offset indentations is oriented a distance away from an adjacent indentation. The distance between indentations is equivalent to about ½ the diameter of the adjacent indentation.

The offset indentations have diameters that range between about 3/20 inches to about ¾ inches. In one version, all diameters for offset indentations on a collar can be the same diameter. In another embodiment, some of the diameters can be larger than other diameters and still be usable here.

For example, for a collar about 6 inches in width, and about 2.66 inches long, about 52 offset indentations are formed in the outer side of the collar. Each offset indentation of this example is contemplated to be round with a diameter of about ½ inch. In other embodiment, the offset indentations could also have an elliptical shape. In this example, 6 rows of offset indentations are formed around the collar. It is contemplated that between about 4 rows and about 8 rows of the offset indentations can be used on each collar, depending on the size and use of the collar.

Specifically, for this 6 inch exemplary collar, it is contemplated that the offset indentations are oriented diagonally to the collar axis. The indentations are oriented away from each other such that a second indentation is formed diagonal to the first indentation at a distance about ½ the diameter of the adjacent offset indentation.

For larger casing savers, there may be more rows than 6, or there may be larger diameter offset indentations.

Offset indentations preferably have consistent depths for each collar. Depending on the size of the collar, the offset indentations can range in depth between about 3/20 inches and about ¾ inches.

The offset indentations can have a preferred diameter ranging from about ¼ inches to about 1 inch. An exemplary outer diameter for a collar could be 6.7 inches.

A metal carbide insert is pressed into each offset indentation.

Each metal carbide insert may have at least one knurl for providing an interference fit into an offset indentation.

A knurl is a ridge formed on the body of the insert near the top and extending to the bottom of the insert. Knurls can be about 1/16 inch ridges all around the metal carbide insert body. More than 1 knurl are usable herein per metal carbide insert. More than 1 knurl helps to provides a secure interference fit into the offset indentation.

It is contemplated that one metal carbide insert, such as a tungsten carbide insert is used per offset indentation and the insert may have one or more knurls.

Once the metal carbide inserts are inserted into the offset indentations a wear resistant pad is formed around the collar which wears out first, before the collar, and before the drill equipment on which the collar is disposed.

The wear resistant pad, formed from the tops of the metal carbide inserts in a spaced apart relationship, is not a complete coating on the collar surface. However, the wear resistant pad absorbs a substantial portion of the friction from the walls of the borehole preventing degradation of the sub body due to friction while drilling equipment turns.

At least one spring locking apparatus, and up to three such locking apparatus, are contemplated for use with the collar to hold the collar to the body forming an engaged, but detachable sub assembly.

The body of the sub or the tubular can secure to the spring locking apparatus using either one or more locking indentations formed in the body that correspond to the spring locking apparatus or a locking groove can be milled into the tubular or the body of the sub around the perimeter of the body permitting elements of a spring locking apparatus to grab the body or tubular to hold the collar to the body. In an embodiment, the locking groove is above a seating groove that is also milled into the body. The seating groove further contains a sealing means, such as a silicon gasket for providing sealing while supplying a secure connected between collar and the body.

Usable spring locking apparatus can be ball and spring locking fasteners purchased from Granger or another industrial supply house.

The collar is contemplated to be usable with subs, tubulars like drill pipe, tool joints, pieces of workover equipment, or combinations of these drilling components.

These embodiments provide the benefit that the individual metal carbide inserts can be easily replaced if they fly off the collar during drilling.

Another feature is that the entire wear collar can be replaced easily and quickly by the drilling hand without the need for formal training, as in the case of welding collars to bodies or tubulars.

The metal carbide inserts are contemplated to be made from tough metals. For example, the metal carbide insert can be made from tungsten carbide with about 8 percent to about 12 percent cobalt. The metal carbide inserts can be made of numerous alloys that provide substantial wear properties.

This embodiment is highly versatile, and enables a drill pipe to use a first collar with a first set of inserts for providing resistant to certain types of friction, and then replaced to a second collar with a different set of inserts that provides a different level of wear protection.

In an embodiment, the metal carbide inserts are contemplated to be cylindrical in shape for the body with a cap that is a dome, such as a half circle. The "cap" can be square or another shape if desired.

The cap or domed portion of the metal inserts are contemplated to rise about 1/10 inch to about 1/4 inch above the collar forming a "button" over the collar. Enough of these "buttons" form, a wear resistant pad on the outside of the collar which does not require coating of the entire surface.

Another benefit of the embodiments is that the metal carbide inserts do not need to be precisely fit into the offset indentations. The collar enables less skilled workers to make and use the collar which is a significant cost saving to known wear saving devices that require braising, welding, or complicated insertion techniques.

In an embodiment, the invention contemplates using knurls on the body of the metal inserts to get around the fine tolerances required for interference fits. The metal carbide inserts can be pushed into the offset indentations in the collar and the knurl assists in creating a secure fit. When the metal carbide insert is pressed in, the carbide which is harder than the softer collar metal, deforms the collar metal. The metal carbide insert is then locked into place without need for adhesives, other fasteners or welding.

A benefit of the invention is in using the diagonal "offset" pattern for the offset indentations with metal carbide inserts. This diagonal pattern, that is an "X" like pattern along the collar outer side requires fewer metal carbide inserts than horizontal patterns, in parallel rows at 90 degree angles to the sleeve axis. This benefit of having fewer carbide inserts lowers the cost of manufacture of this collar.

FIG. 1 shows an embodiment of a sub assembly (4) with a body (6) covered with a collar (10) held to the sub body using one of the plurality of spring locking apparatus (26*a*). The collar (10) is shown having a collar axis (11). Two or three spring locking apparatus are contemplated for use to engage locking indentations which can not be seen in this embodiment, on the body (6).

This FIG. 1 shows the collar (10) having an outer side (14).

Figure 2:
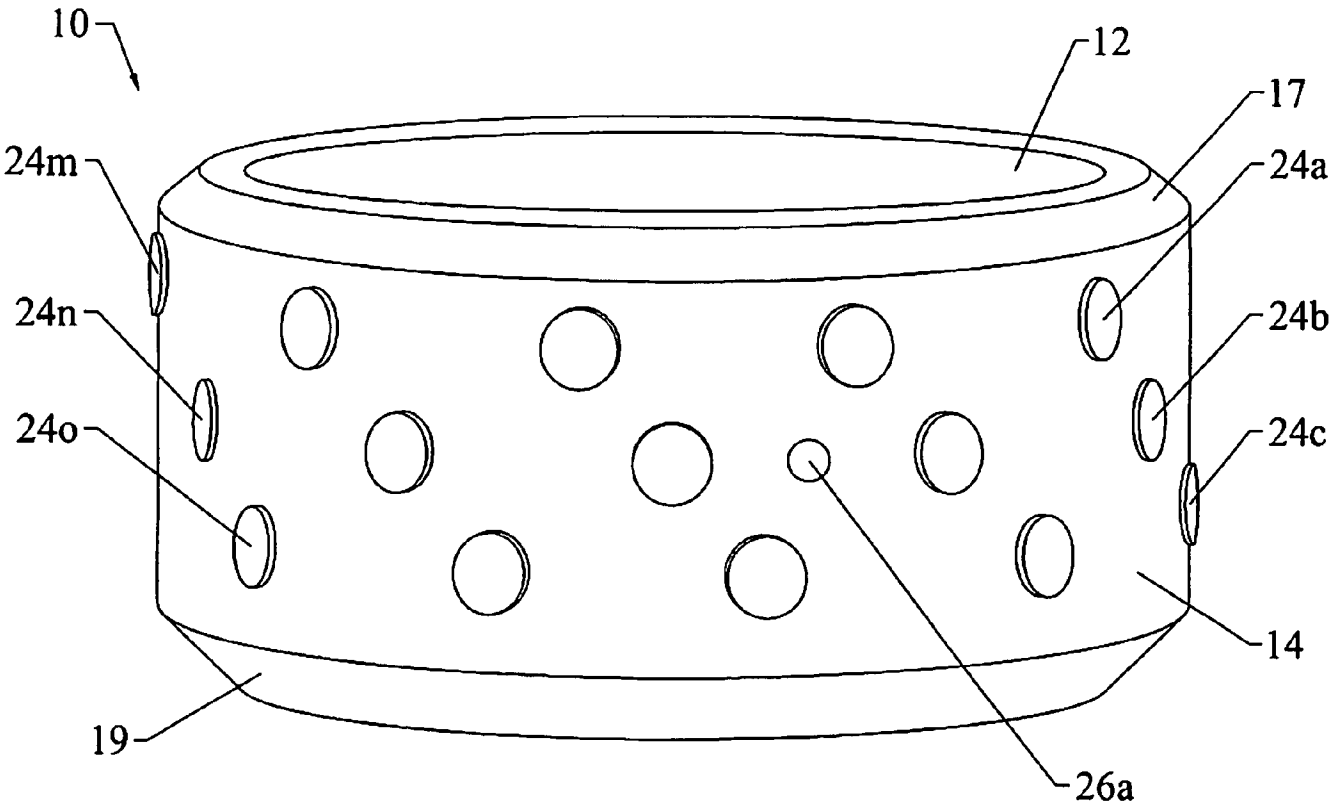
FIG. 2 is a detail of the collar.

FIG. 2, the perspective view of the collar (10), shows the collar (10) having an inner side (12) and the outer side (14).

Returning to FIG. 1, the collar (10) securely engages the body (6) but in a removable manner. This removable engagement permits the outer side of the collar to receive a substantial portion of frictional wear from drilling of a borehole without damage to the body. The collar acts as a "casing saver".

The collar (10) is shown having a plurality of tungsten carbide inserts inserted in offset indentations (not shown in this Figure) forming a wear resistant pad (34).

The offset indentations engage the carbide metal inserts with an interference fit or press fit.

In this FIG. 1, the offset indentations have identical diameters and the carbide inserts have caps all of the same size. Offset indentations have a diameter ranging between about 3/20 inches and about 3/4 inches.

It is contemplated that the collar has a collar outer diameter (15) which is slightly larger than the body outer diameter (9).

The collar (10) is also shown having a collar top square cut edge (17) opposite a collar bottom beveled edge (19). The collar bottom beveled edge that fits within a seating groove (27) on the body. Seating groove (27) is more clearly depicted in FIG. 3.

A sealing means (25), such a silicon gasket, fit into the seating groove (27) formed in the body (6). Seating groove (27) with sealing means (25) allows the collar to have a sealing engagement with the body (6).

FIG. 2 shows a detail of the collar (10) with the tungsten carbide inserts (24*a*, 24*b*, 24*c*, 24*m*, 24*e*, 24*f*, and . . . n) installed in a "X" pattern using linear rows diagonal to the collar axis. The outer side (14) and the inner side (12) of the collar (10) are also shown.

In this embodiment of FIG. 2, it is contemplated that each metal carbide insert is an insert that has a total weight of about 8 weight percent to about 12 weight percent cobalt over a tungsten carbide.

Figure 3:
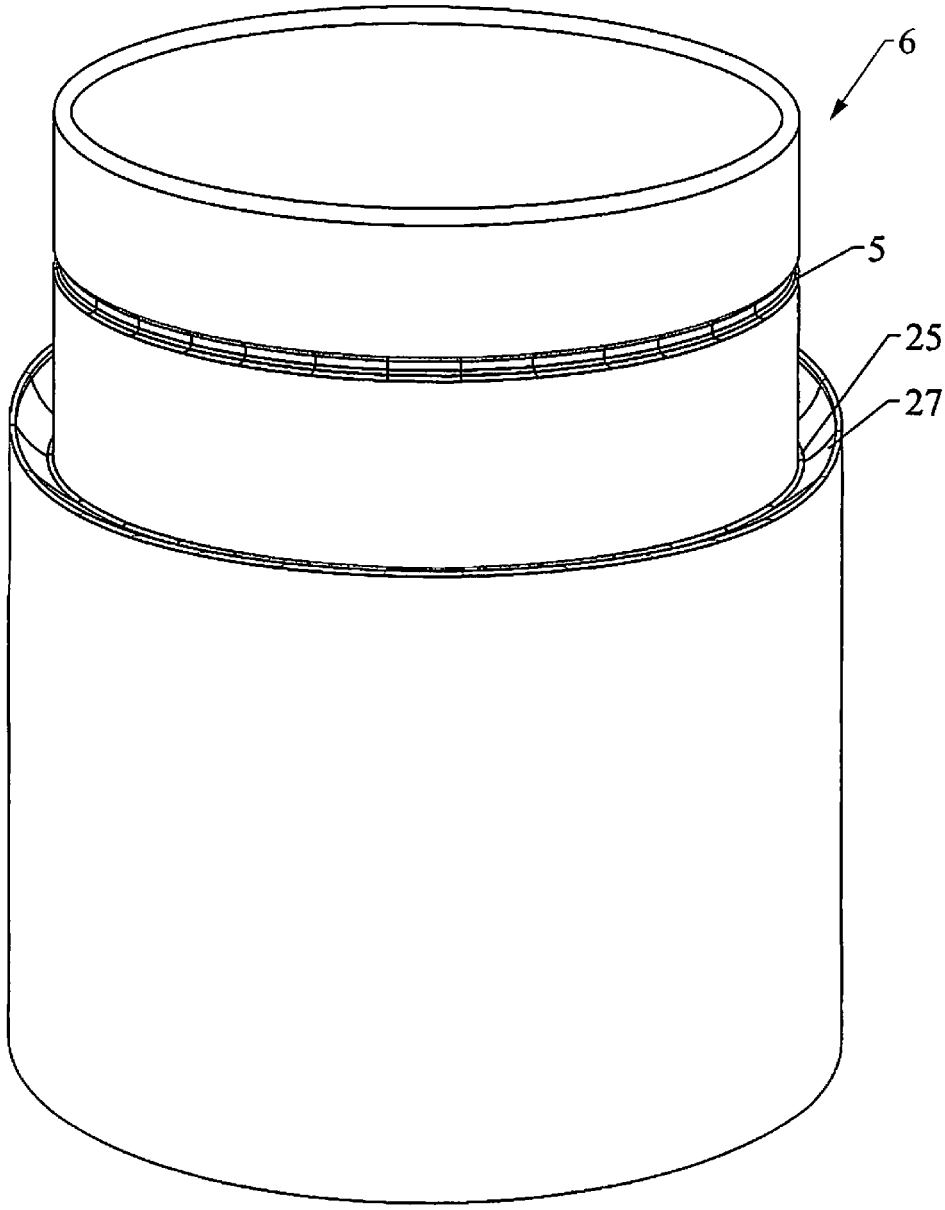
FIG. 3 shows a detail of the body of the sub assembly without the collar.

FIG. 3 shows a perspective view of a body (6) with a locking portion (5) that can be a locking groove formed on the perimeter of the body or at least two locking indentations formed on the body opposite each other. The body can be made from a manganese alloy.

The locking groove version of the locking portion is shown in this figure. The locking portion is disposed at a midpoint for engaging with the collar. It is contemplated that the locking groove could be slightly off center of the collar. In another embodiment, not shown in this figure, a first and a second locking indentation can be used on the body, opposite each other, enabling at least two locking fasteners to lock into each locking indentation to hold the collar to the tubular or body.

FIG. 3 also shows that sealing means (25) fits into seating groove (27). The collar (10) can slide located on the body (6) and into that seating groove. The sealing means (25) which can be a gasket or another removable sealing material.

Figure 4:
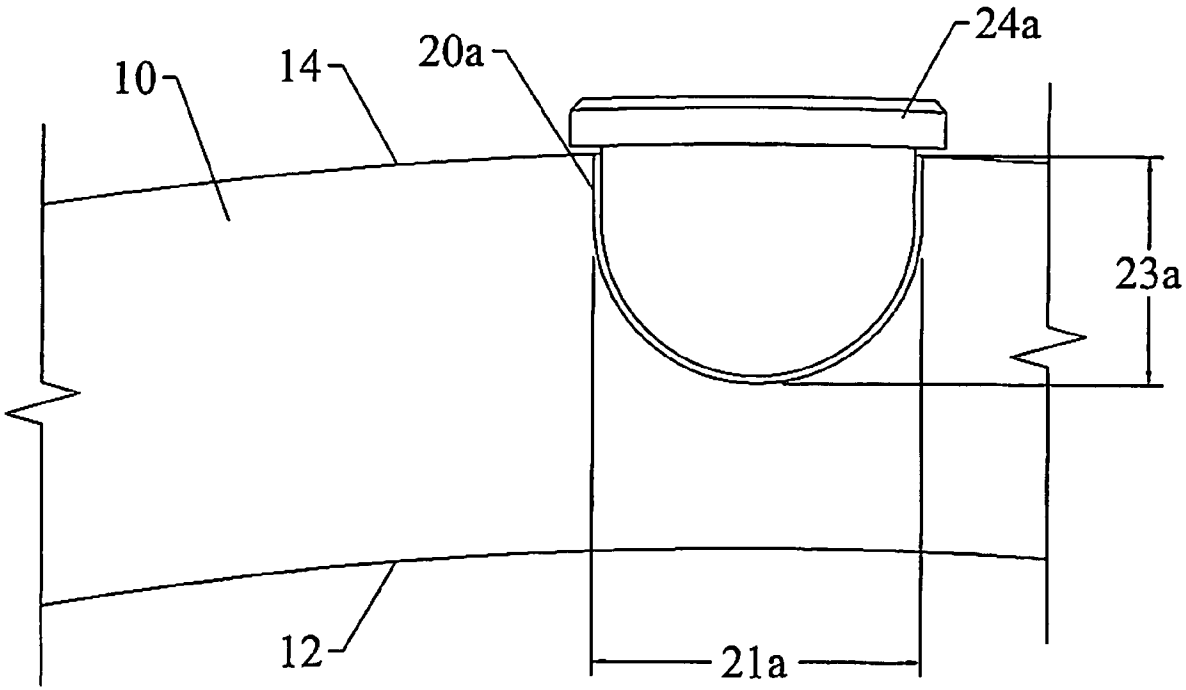
FIG. 4 depicts a cross sectional view of a collar with an metal carbide insert.

FIG. 4 shows a cut away view of a metal carbide insert engaging the collar. The tungsten carbide insert (24*a*) is part of the wear resistant pad (34) of the outer side (14) of the collar. The metal carbide insert (24*a*) has a ridged surface, or knurl, providing a tight interference fit with the offset indentation (20*a*). The offset indentation (20*a*) is depicted with an offset indentation diameter (21*a*) and an offset indentation depth (23*a*).

The tungsten carbide insert has a cap portion that extends above the offset indentation. The cap can be square, rectangular, domed or another shape.

The metal inserts can have a cylindrical metal body section with the cap top, forming a "T" shape. The cap can rise about 1/10 inch to about 1/4 inch above the outer side of the collar.

While these embodiments have been described with emphasis on the embodiments, it should be understood that within the scope of the appended claims, the embodiments might be practiced other than as specifically described herein.

What is claimed is:

1. An apparatus for protecting a subassembly with a body having a body outer diameter for use inside a borehole of a well comprising:

a collar having a collar axis, an inner side and an outer side and a collar outer diameter larger than the body outer diameter, a collar top square cut edge and a collar bottom beveled edge;

a plurality of offset indentations formed on the outer side of the collar, wherein each offset indentation in rows of four to eight offset indentations along an angle sloping from about 7.5 degrees to about 45 degrees from the collar axis;

a plurality of a metal carbide inserts, each fitted into an offset indentation with an interference fit forming a wear resistant pad on the outer side of the collar;

a sealing means disposed between the collar bottom beveled edge and the body; and at least two spring locking apparatus disposed in inner side of the collar, wherein each spring locking apparatus engages a locking portion on the body thereby forming a sealed wear protected subassembly.

2. The apparatus of claim 1, wherein the sealed protected sub assembly is a tubular shape.

3. The apparatus of claim 1, wherein the wear resistant pad provides a 100 percent wear resistance using metal carbide inserts covering the collar.

4. The apparatus of claim 1, wherein each of the offset indentations is oriented a distance away from an adjacent offset indentation at a distance equivalent to about 1/2 the diameter of the adjacent offset indentation.

5. The apparatus of claim 1, wherein the offset indentations have a diameter ranging between about 3/20 inches to about 3/4 inches.

6. The apparatus of claim 1, wherein the metal carbide insert is a tungsten carbide insert.

7. The apparatus of claim 1, wherein the body comprises a manganese alloy.

8. The apparatus of claim 1, wherein the metal carbide inserts are cylindrical, or domed in shape.

9. The apparatus of claim 1, wherein the collar has an inner diameter between about 4.5 inches to about 10 inches.

* * * * *